US012617056B2

(12) United States Patent
Chuang

(10) Patent No.: US 12,617,056 B2
(45) Date of Patent: May 5, 2026

(54) BELT SANDER CAPABLE OF AUTOMATICALLY ADJUSTING OSCILLATING POSITION OF ABRASIVE BELT

(71) Applicant: Bor-Yann Chuang, Taichung (TW)

(72) Inventor: Bor-Yann Chuang, Taichung (TW)

( * ) Notice: Subject to any disclaimer, the term of this patent is extended or adjusted under 35 U.S.C. 154(b) by 301 days.

(21) Appl. No.: 18/625,222

(22) Filed: Apr. 3, 2024

(65) Prior Publication Data

US 2025/0312880 A1 Oct. 9, 2025

(51) Int. Cl.
*B24B 21/18* (2006.01)
*B24B 47/20* (2006.01)

(52) U.S. Cl.
CPC ..... *B24B 21/18* (2013.01); *B24B 47/20* (2013.01)

(58) Field of Classification Search
CPC ..... B24B 21/18; B24B 47/20
See application file for complete search history.

(56) References Cited

U.S. PATENT DOCUMENTS 3,900,973 A * 8/1975 van der Linden ..... B24B 21/18 451/300
4,021,970 A * 5/1977 Przygocki ..... B24B 21/18 D25/22
4,187,645 A * 2/1980 Lind ..... B24B 21/18 451/297
4,337,598 A * 7/1982 Barth ..... B24B 21/18 451/526
6,089,958 A * 7/2000 Costa ..... B24B 21/04 451/300
6,299,512 B1 * 10/2001 Costa ..... B24B 7/28 451/300
6,386,958 B1 * 5/2002 Wang ..... B24B 21/18 451/296
7,422,515 B1 * 9/2008 Chang ..... B24B 21/20 451/300
9,327,383 B1 * 5/2016 Chuang ..... B24B 21/18
2004/0087261 A1 * 5/2004 Wang ..... B24B 21/18 451/296
2004/0097178 A1 * 5/2004 Caporusso ..... B24B 21/16 451/311

(Continued)

*Primary Examiner* — Omar Flores Sanchez
(74) *Attorney, Agent, or Firm* — BruceStone LLP; Joseph A. Bruce

(57) ABSTRACT

A belt sander includes a rotary unit, an oscillating unit, an abrasive belt position detector, a first sensor, a second sensor, and an electric motor control module. The rotary unit includes a retaining seat and an oscillating seat. A lower wheel is pivotally connected to the retaining seat. An upper wheel is pivotally connected to the oscillating seat. An abrasive belt is mounted on the upper wheel and the lower wheel. A recess is formed on the oscillating seat. The oscillating unit includes an electric motor, an eccentric bushing, and a bearing. The bearing is located in the recess. The electric motor drives the upper wheel to oscillate through the eccentric bushing and the bearing, and the abrasive belt is reciprocated left and right. The electric motor is controlled to run or stop running to achieve the function of automatically adjusting the oscillating position of the abrasive belt through the abrasive belt position detector, the first sensor and the second sensor.

8 Claims, 9 Drawing Sheets

(56) References Cited

U.S. PATENT DOCUMENTS

| | | | | |
|---|---|---|---|---|
| 2014/0213154 | A1* | 7/2014 | Seki | B24B 21/002 451/303 |
| 2020/0047305 | A1* | 2/2020 | Balducci | B24B 7/28 |
| 2022/0055175 | A1* | 2/2022 | Li | B65D 83/0817 |
| 2022/0402088 | A1* | 12/2022 | Hasegawa | B24B 21/14 |
| 2025/0001544 | A1* | 1/2025 | Hülsemann | B24B 21/10 |

* cited by examiner

BELT SANDER CAPABLE OF AUTOMATICALLY ADJUSTING OSCILLATING POSITION OF ABRASIVE BELT

FIELD OF THE INVENTION

The present invention relates to a belt sander, and more particularly to, a belt sander capable of automatically adjusting the oscillating position of an abrasive belt.

BACKGROUND OF THE INVENTION

A belt sander is widely used for wooden products, furniture, and so on. The surface of wood has to be processed appropriately by sanding and polishing through the belt sander to enhance the overall appearance and fine modification. As disclosed in U.S. patent application Ser. No. 17/542,404, an oscillating device of a belt sander comprises rollers and wheels located on both sides of a belt sander. A motor drives the abrasive belt to rotate through the rollers, and an electric motor drives the wheels to oscillate left and right, so that the abrasive belt is reciprocated up and down, thereby improving the quality and efficiency of sanding or polishing.

However, in the conventional belt sander, the wheels are oscillated through the electric motor, the output shaft, the linking member, the eccentric shaft and the frame, having the disadvantages of large number of components and high complexity of assembly. Besides, the difference in the circumference of the two sides of the abrasive belt leads to inconsistent tension, which in turn affects the oscillating position of the abrasive belt. Accordingly, the inventor of the present invention has devoted himself based on his many years of practical experiences to solve these problems.

SUMMARY OF THE INVENTION

The primary object of the present invention is to provide a belt sander capable of automatically adjusting the oscillating position of an abrasive belt. When the abrasive belt is reciprocated left and right, the oscillating position of the abrasive belt is automatically adjusted.

In order to achieve the above object, the belt sander provided by the present invention comprises a base, a frame, a rotary unit, an oscillating unit, an abrasive belt position detector, a first sensor, a second sensor, and a control unit. The base includes at least one workbench thereon. The frame is disposed on one side of the base. The frame has a retaining bracket. The rotary unit includes a retaining seat and a motor fixed to the retaining bracket. A lower wheel is pivotally disposed on the retaining seat. The lower wheel is connected to the motor. One end of a central axle is fixed to the retaining seat. Another end of the central axle is fixed to an oscillating seat. A recess is formed on the oscillating seat. An upper wheel is pivotally connected to the oscillating seat. An abrasive belt is mounted on the upper wheel and the lower wheel. The oscillating unit includes an electric motor, an eccentric bushing, and a bearing. The electric motor is connected to an output shaft. The eccentric bushing and the output shaft are arranged eccentrically and fitted on a periphery of the output shaft. The bearing is fitted on the eccentric bushing and located in the recess. The abrasive belt position detector is disposed on the retaining seat for detecting a position of the abrasive belt. The first sensor and the second sensor are configured for confirming an oscillating angle of the oscillating seat. The control unit includes an electric motor control module. The electric motor control module is electrically connected to the abrasive belt position detector, the first sensor and the second sensor, thereby controlling the electric motor to run or stop running.

In the belt sander provided by the present invention, the motor drives the abrasive belt to rotate, the electric motor drives the upper wheel to oscillate through the eccentric bushing and the bearing, and the abrasive belt is reciprocated left and right. Besides, the belt sander provided by the present invention has the ability to maintain the oscillating angle of the oscillating seat and automatically adjust the oscillating position of the abrasive belt through the abrasive belt position detection module, the first oscillating angle detection module and the second oscillating angle detection module.

DETAILED DESCRIPTION OF THE PREFERRED EMBODIMENTS

Embodiments of the present invention will now be described, by way of example only, with reference to the accompanying drawings.

Figure 1:
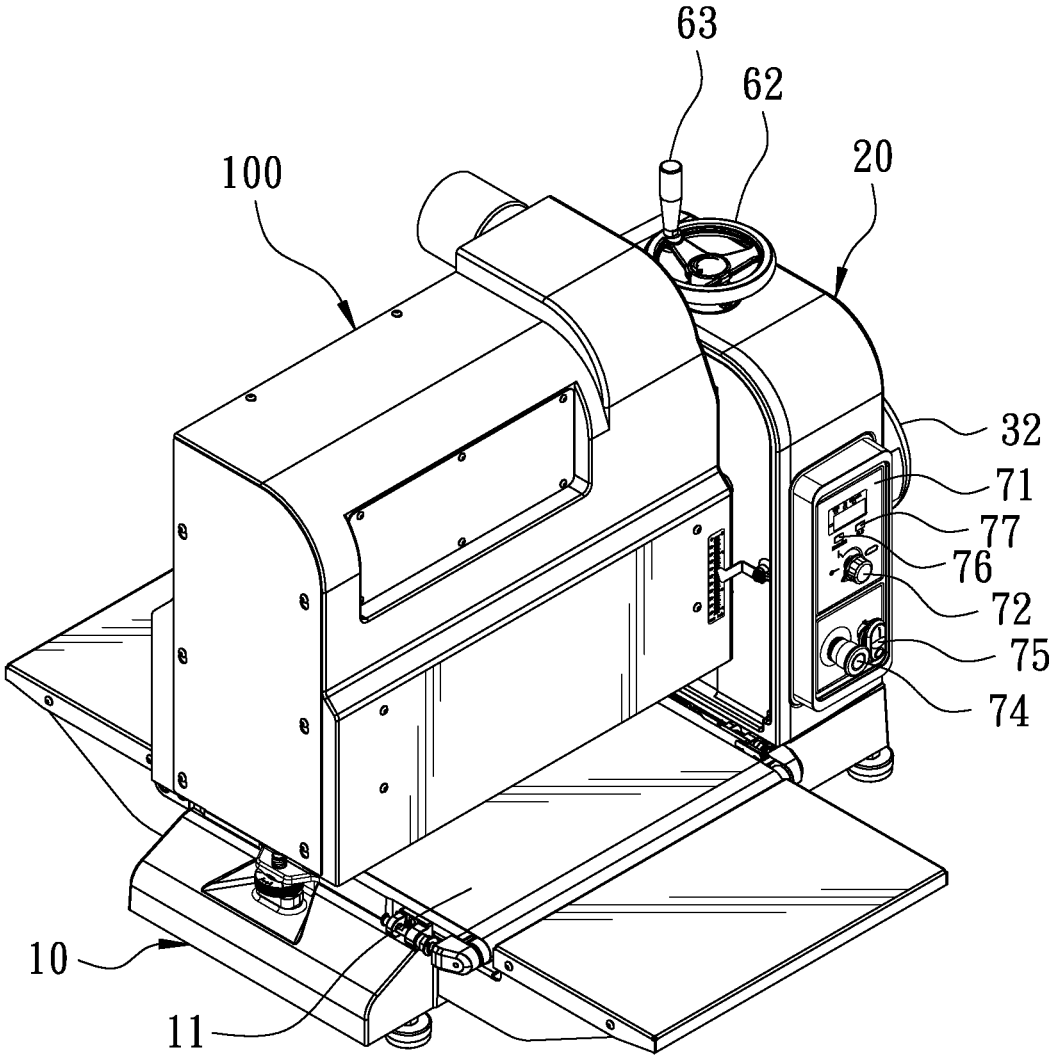
FIG. 1 is a perspective view of a preferred embodiment of the present invention.
Figure 2:
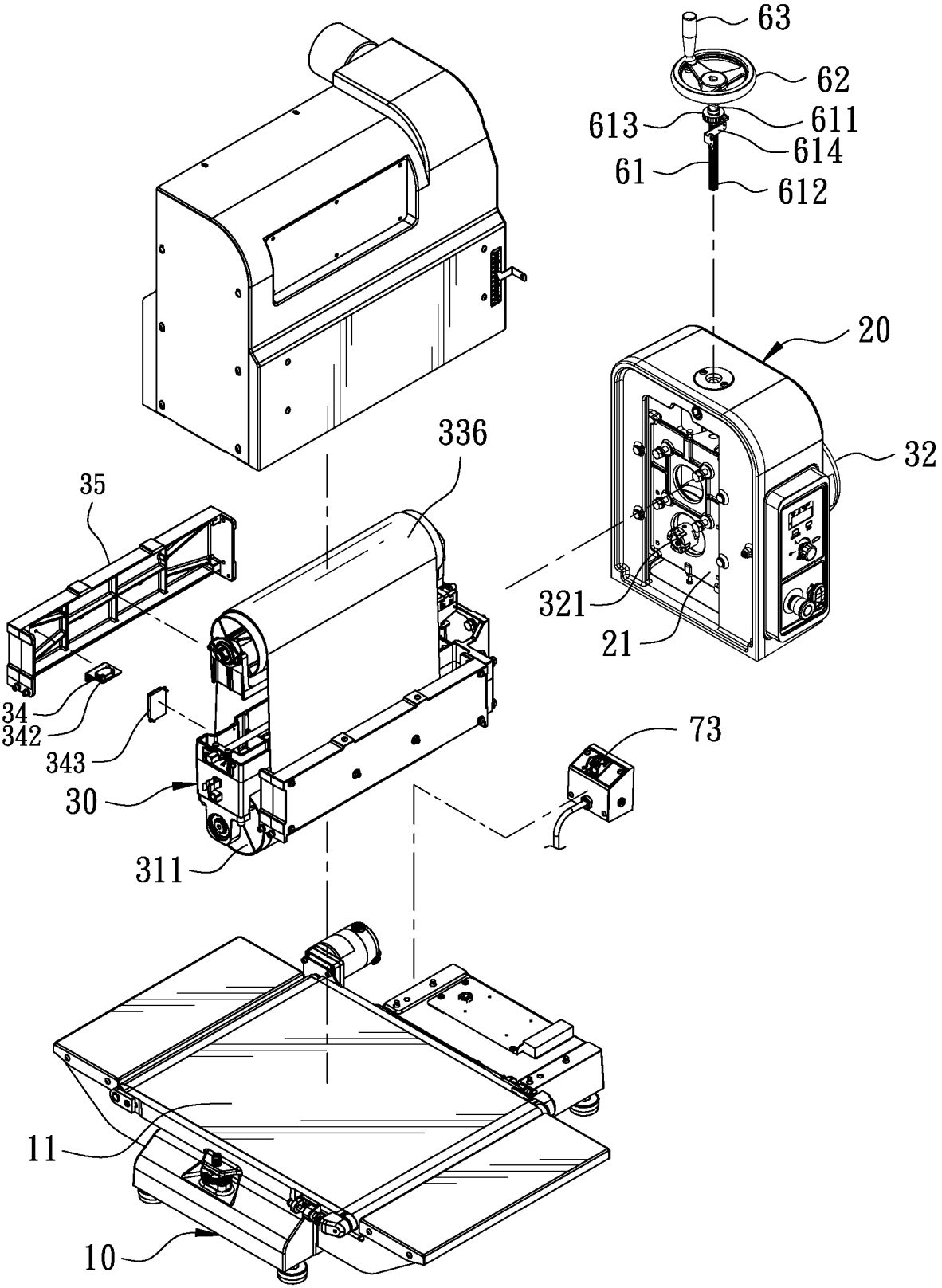
FIG. 2 is an exploded view of the preferred embodiment of the present invention.

FIG. 1 is a perspective view of a preferred embodiment of the present invention. FIG. 2 is an exploded view of the preferred embodiment of the present invention. The present invention discloses a belt sander 100 capable of automatically adjusting the oscillating position of an abrasive belt. The belt sander 100 comprises a base 10, a frame 20, a rotary unit 30, an oscillating unit 40, a lifting adjustment unit 60, and a control unit 70.

The base 10 includes at least one workbench 11 thereon. The workbench 11 is configured for placement of an object to be sanded.

The frame 20 is vertically disposed on one side of the base 10. The frame 20 has a vertical retaining bracket 21.

Figure 3:
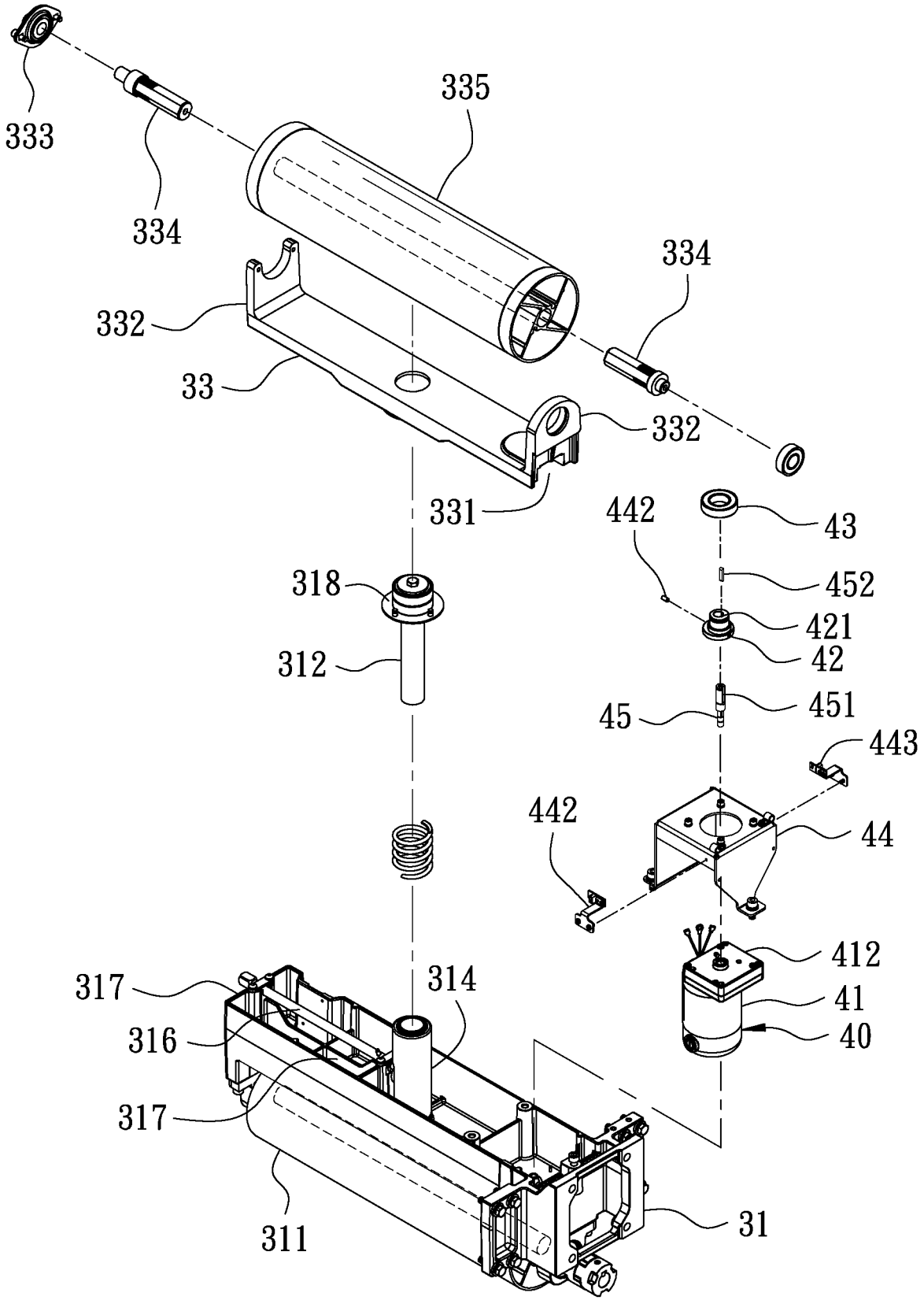
FIG. 3 is a partial exploded view of the preferred embodiment of the present invention, illustrating the rotary unit and the oscillating unit.

The rotary unit 30, referring to FIG. 3, includes a retaining seat 31 and a motor 32. The retaining seat 31 and the motor 32 are fixed to the retaining bracket 21 of the frame 20. A lower wheel 311 is pivotally disposed at the bottom of the retaining seat 31. The lower wheel 311 is located above the workbench 11. The lower wheel 311 is connected to a transmission shaft 321 of the motor 32 so that the lower wheel 311 is driven to rotate. One end of a central axle 312 is fixed to the center of the top of the retaining seat 31. The other end of the central axle 312 extends upward and is connected to an oscillating seat 33. A recess 331 is formed on one side of the bottom of the oscillating seat 33 close to the frame 20. Two sides of the top of the oscillating seat 33 have retaining portions 332 extending upward. A rotating shaft 334 is pivotally connected to one of the retaining portions 332. Another rotating shaft 334 is pivotally connected to the other retaining portion 332 through a rotating shaft seat 333. An upper wheel 335 is pivotally connected to the rotating shafts 334. An abrasive belt 336 is mounted on the upper wheel 335 and the lower wheel 311. Two side seats 35 are disposed on two sides of the retaining seat 31, respectively. The abrasive belt 336 passes between the retaining seat 31 and the side seats 35.

Figure 4:
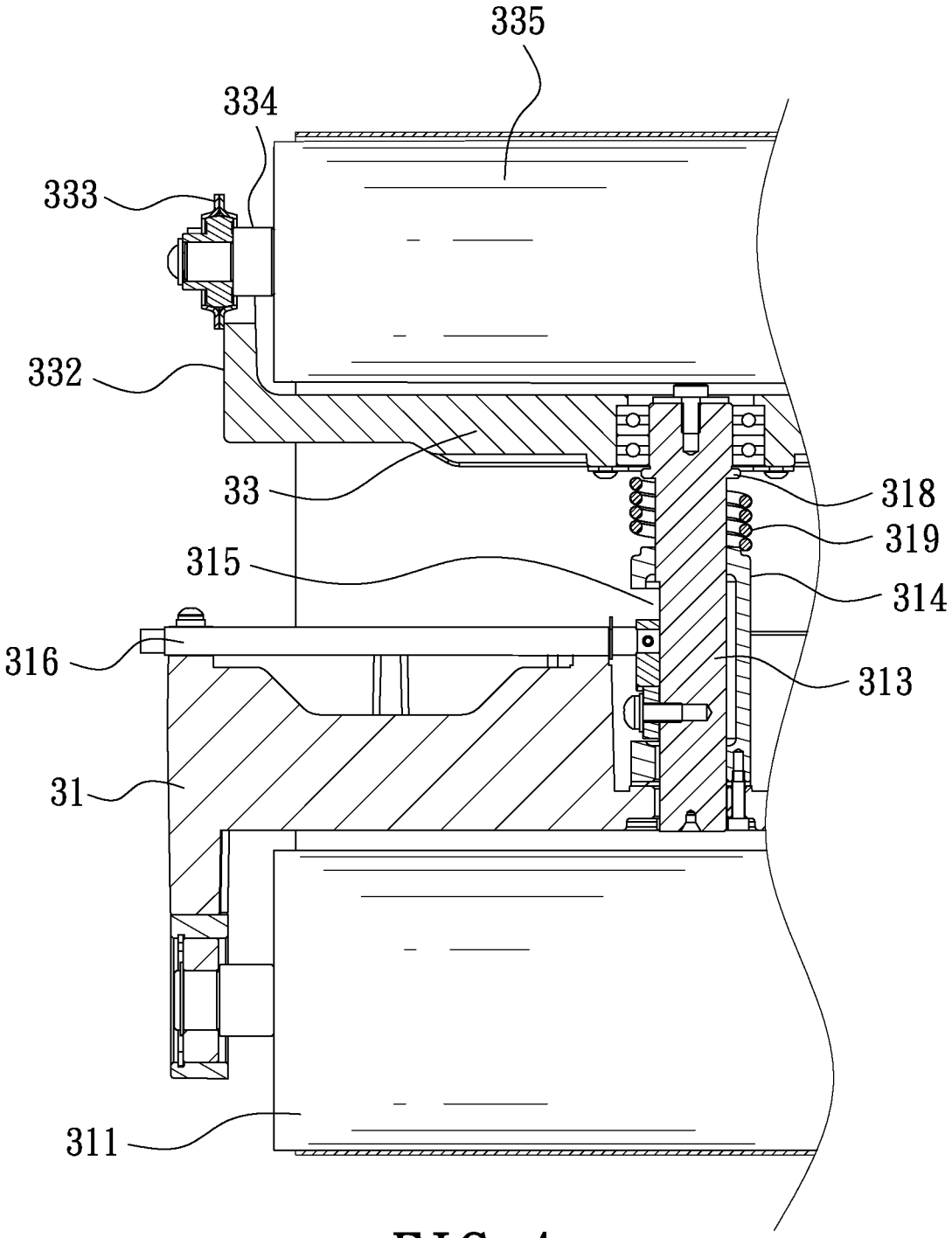
FIG. 4 is a partial cross-sectional view of the preferred embodiment of the present invention.

Referring to FIG. 4, the central axle 312 has a retaining section 31. A retaining sleeve 314 is fitted on the retaining section 313. The retaining sleeve 314 is fixed to the top of the retaining seat 31. One side of the retaining sleeve 314 has an opening 315. A retaining rod 31 extending radially, outwardly is fixed to the central axle 312 at the position of the opening 315. The retaining rod 316 is further fixed on a pair of positioning plates 317 extending upward from the top of the retaining seat 31, thereby keeping the position of the central axle 312. The outer circumference of the central axle 312, close to the oscillating seat 33, has a retaining ring 318 extending outwardly. A spring 319 is fitted on the central axle 312 between the retaining ring 318 and the retaining sleeve 314 for increasing the supporting force of the retaining rod 316. In the embodiment of the present invention, the oscillating seat 33 and the retaining ring 318 are assembled with the central axle 312 using two ball bearings, and then hexagonal screws and flat washers are screwed to the tops the oscillating seat 33 and the retaining ring 318 to eliminate the gaps, so that they will not be loose, thereby allowing the oscillating seat 33 to move more smoothly.

Figure 5:
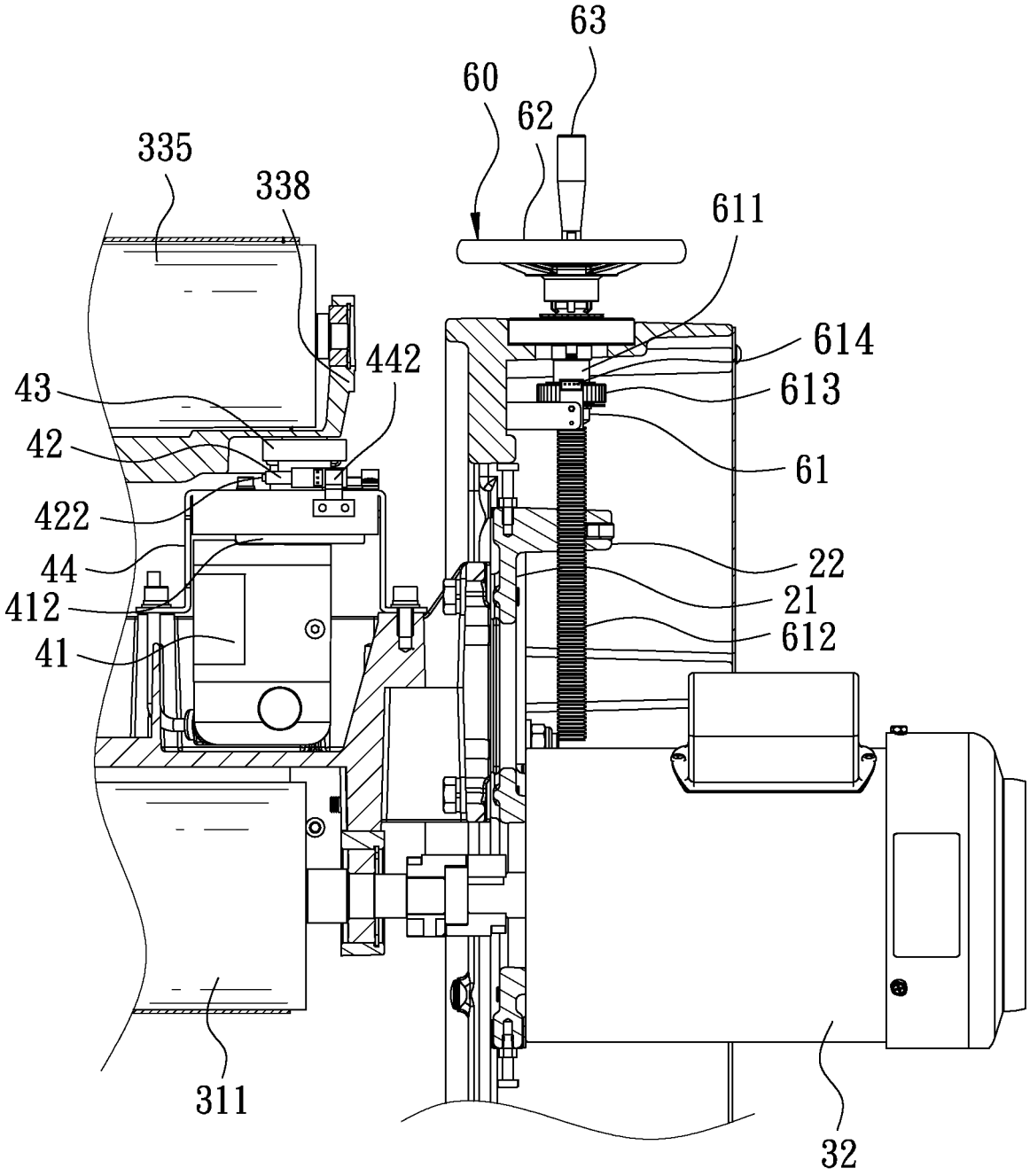
FIG. 5 is another partial cross-sectional view of the preferred embodiment of the present invention, illustrating the lifting adjustment unit.
Figure 6:
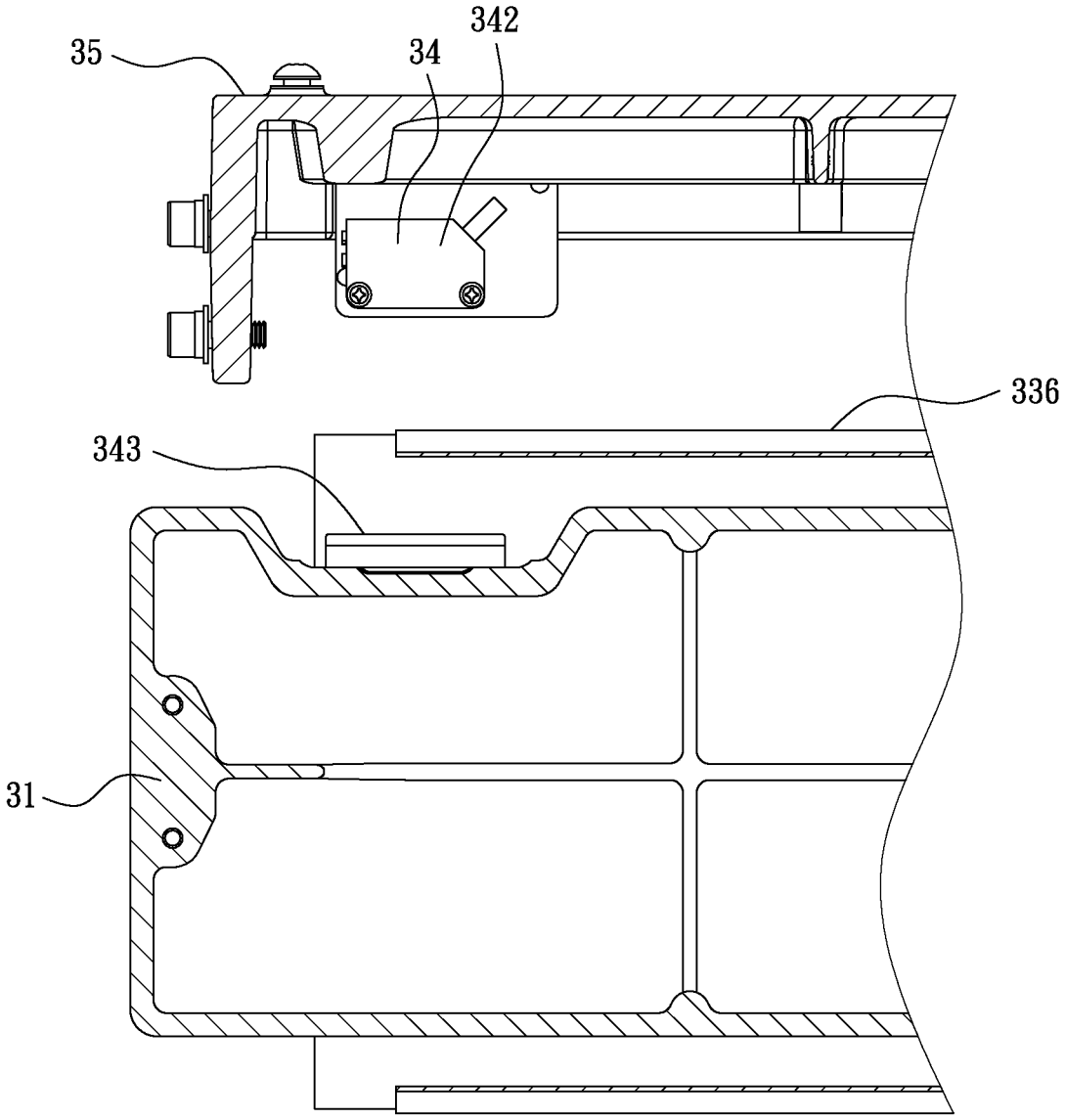
FIG. 6 is a further partial cross-sectional view of the preferred embodiment of the present invention, illustrating the abrasive belt position detector.

The oscillating unit 40, referring to FIG. 3, FIG. 5 and FIG. 6, includes an electric motor 41, an eccentric bushing 42, and a bearing 43. The electric motor 41 is fixed to an electric motor bracket 44 on one side of the top of the retaining seat 31 close to the frame 20. A transmission shaft 411 of the electric motor 41 is connected to an output shaft 45 through a speed reduction mechanism 412, i.e., a speed reduction gear set. The free end of the output shaft 45 has a receiving groove 451. The eccentric bushing 42 is fitted on the periphery of the output shaft 45. The eccentric bushing 42 and the output shaft 45 are arranged eccentrically. The eccentric bushing 42 has an accommodating groove 421 corresponding to the receiving groove 451. A pin 452 is inserted in the receiving groove 451 and the accommodating groove 421. The bearing 43 is a ball bearing. A magnetic element, such as a magnet 422, is insertedly connected to the periphery of the lower section of the eccentric bushing 42. The bearing 43 is concentrically arranged and fitted on the outer periphery of the upper section of the eccentric bushing 42 and is located in the recess 331. Thus, when the electric motor 41 is running, the bearing 43 rotates eccentrically, and the bearing 43 drives the oscillating seat 33 to move back and forth.

The lifting adjustment unit 60, referring to FIG. 5, includes a lifting rod 61, a rotary disk 62 on one end of the lifting rod 61, and a handle 63 on the rotary disk 62 for the user to operate the lifting adjustment unit 60. The lifting rod 61 has a detection section 611 and a threaded section 612. A graduated sleeve 613 is fitted on the detection section 611. The graduated sleeve 613 and a detector 614 are arranged oppositely. The detector 614 is fixed to the frame 20 for detecting the rotation angle of the graduated sleeve 613. The threaded section 612 is screwed to a transverse protrusion 22 on the top of the retaining bracket 21. By rotating the rotary disk 62 through the handle 63, the lifting rod 61 is rotated to raise or lower the rotary unit 30 on the retaining bracket 21. The detector 614 detects the rotation angle and the number of revolutions.

Referring to FIG. 3 and FIG. 6, the retaining seat 31 is equipped with an abrasive belt position detector 34. The abrasive belt position detector 34 has a signal terminal 342 and a reflection terminal 343. The signal terminal 342 is located on one side of the side seat 35 facing the retaining seat 31. The reflection terminal 343 is located on the retaining seat 31 opposite the signal terminal 342 for receiving and reflecting signals from the signal terminal 342. When the oscillating seat 33 oscillates, a portion of the abrasive belt 336 will be between the signal terminal 342 and the reflection terminal 43, thereby blocking or not blocking the abrasive belt position detector 34, so that the position of the abrasive belt 336 can be detected.

Referring to FIG. 3 and FIG. 5, a first sensor 442 and a second sensor 443 are provided on the electric motor bracket 44 and are spaced apart from each other. The lower section of the eccentric bushing 42 is located between the first sensor 442 and the second sensor 443. The first sensor 442 and the second sensor 443 are mounted on the symmetrical axes of the eccentric bushing 42. When the oscillating seat 33 oscillates, the first sensor 442 and the second sensor 443 detect the position of the magnet 422 to confirm the oscillating angle of the oscillating seat 33 and whether the oscillating angle is abnormal.

The abrasive belt position detector 34 is an infrared detector or a reflective photoelectric switch for outputting a signal of being in a blocking state or not in a blocking state. The first sensor 442 and the second sensor 443 are magnetic sensors for outputting signals to detect the magnet.

Referring to FIG. 1 and FIG. 2, the control unit 70 is disposed on the frame 20 and electrically connected to the motor 32, the electric motor 41, the abrasive belt position detector 34, the first sensor 442, the second sensor 443 and the detector 614. The control unit 70 has a panel 71, a knob 72, a switch 73, an emergency stop switch 74, a motor switch 75, a unit switching button 76, and a zero return button 77. The panel 71 is configured for displaying the setting parameters of the belt sander 100. The setting parameters include an abrasive height position value, a unit, a unit light signal and a state light signal, but not limited thereto. The abrasive height position value refers to the distance between the lower wheel 311 and the workbench 11. The knob 72 is configured for adjusting the speed of the workbench 11. The switch 73 controls the power on and off of the belt sander 100. The motor switch 75 turns the motor 32 on and off. The unit switching button 76 is configured for switching the unit light signal of the panel 71. The zero return button 77 can reset the abrasive height position value of the panel 71 to zero.

Figure 7:
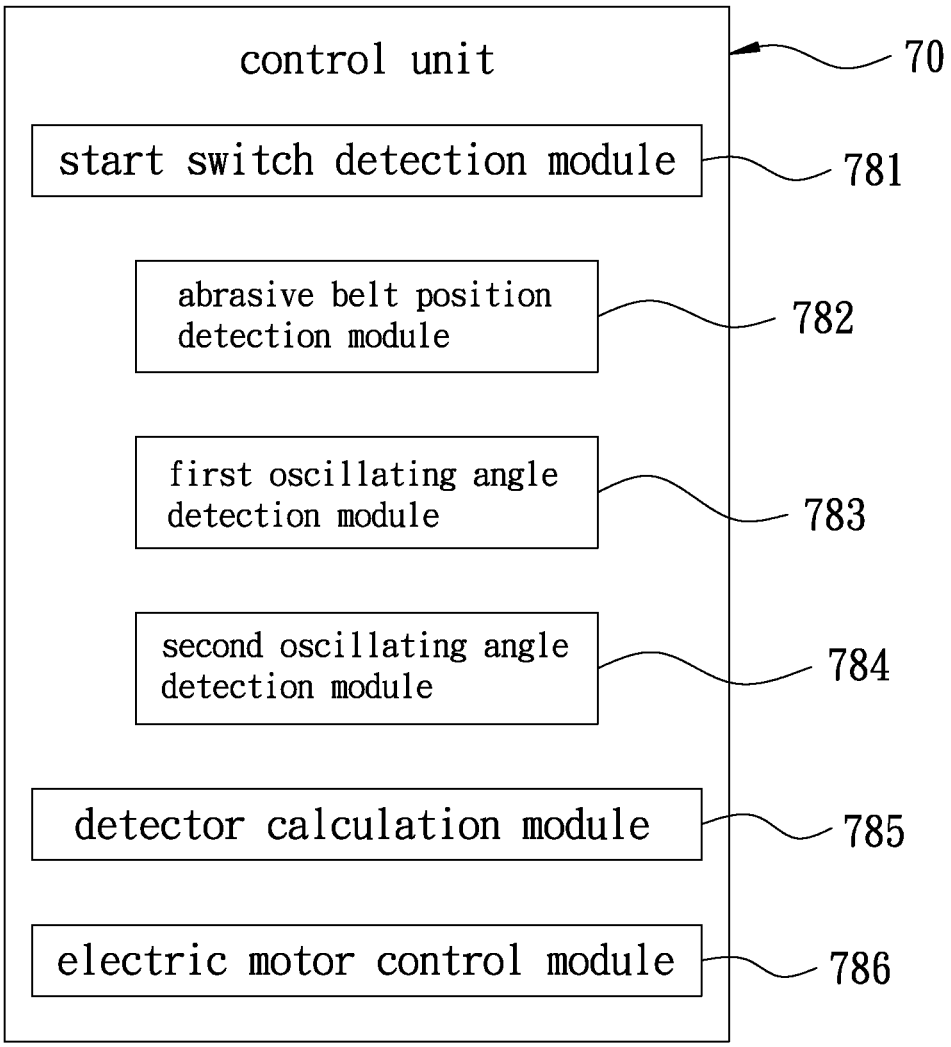
FIG. 7 is a block diagram of the control unit of the preferred embodiment of the present invention.

Referring to FIG. 7, the control unit 70 includes a start switch detection module 781, an abrasive belt position detection module 782, a first oscillating angle detection module 783, a second oscillating angle detection module 784, a detector calculation module 785, and an electric motor control module 786. The start switch detection module 781 can detect whether the knob 72 is zeroed. The abrasive belt position detection module 782 is electrically connected to the abrasive belt position detector 34. The first oscillating angle detection module 783 is electrically connected to the first sensor 442. The second oscillating angle detection module 784 is electrically connected to the second sensor 443. The detector calculation module 785 uses the detector 614 to detect the rotation angle and the number of revolutions of the graduated sleeve 613, and then calculates the distance between the lower wheel 311 and the workbench 11. The electric motor control module 786 controls the electric motor to run or stop running according to the detection results of the abrasive belt position detection module 782, the first oscillation angle detection module 783 and the second oscillation angle detection module 784.

Figure 9:
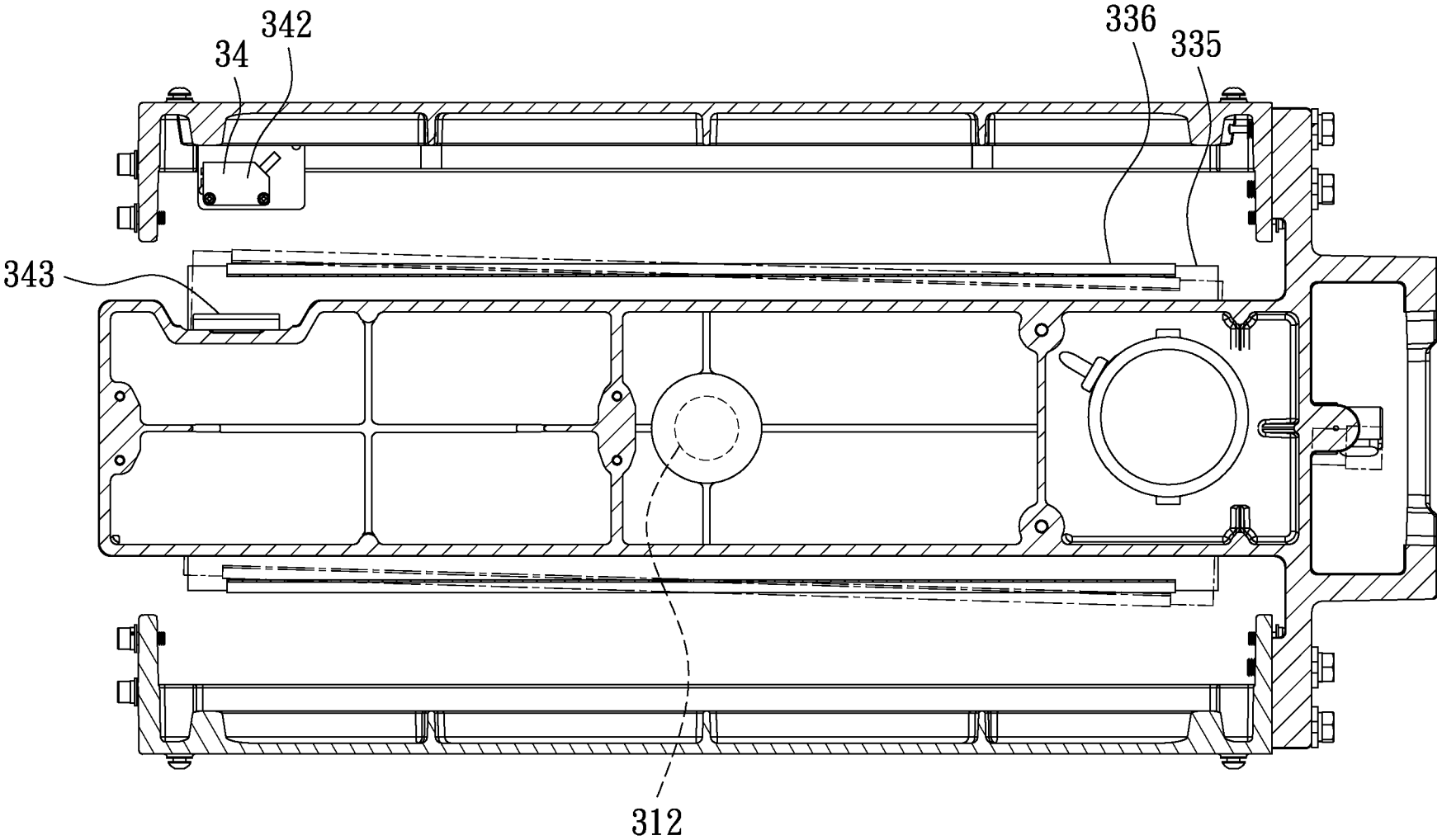
FIG. 9 is a schematic view of the preferred embodiment of the present invention when in use, illustrating that the upper wheel is oscillated.

Please refer to FIG. 1. When the belt sander 100 is in use, the switch 73 is turned on first. At this time, the switch detection module 781 first detects whether the knob 72 is zeroed or not. If the knob 72 is not zeroed, the control unit 70 will lock the motor 32 and the electric motor 41 from running. The user has to turn the knob 72 to the zero position. If the knob 72 is in the zero position and the motor switch 75 is turned on, the control unit 70 will activate the oscillating function and the motor 32 so that the electric motor 41 starts to run. The transmission shaft 321 drives the output shaft 45 to move the eccentric bushing 42 and the bearing 43, thereby moving the oscillating seat 33 and the upper wheel 335 back and forth. This allows the abrasive belt 336 to be reciprocated left and right. As shown in FIG. 9, at the same time, the lower wheel 311 is driven by the transmission shaft 321 of the motor 32, and the upper wheel 335 is pulled by the abrasive belt 336 to rotate. The knob 72 is turned to adjust the speed of the workbench 11. The user can use the belt sander 100 for sanding or polishing operations. In the belt sander provided by the present invention, the abrasive belt 336 is rotated by the motor 32, and the upper wheel 335 is oscillated by the electric motor 41 through the eccentric bushing 42 and the bearing 43, so that the abrasive belt 336 is reciprocated left and right, thereby increasing the efficiency of the abrasive belt 100.

Figure 8:
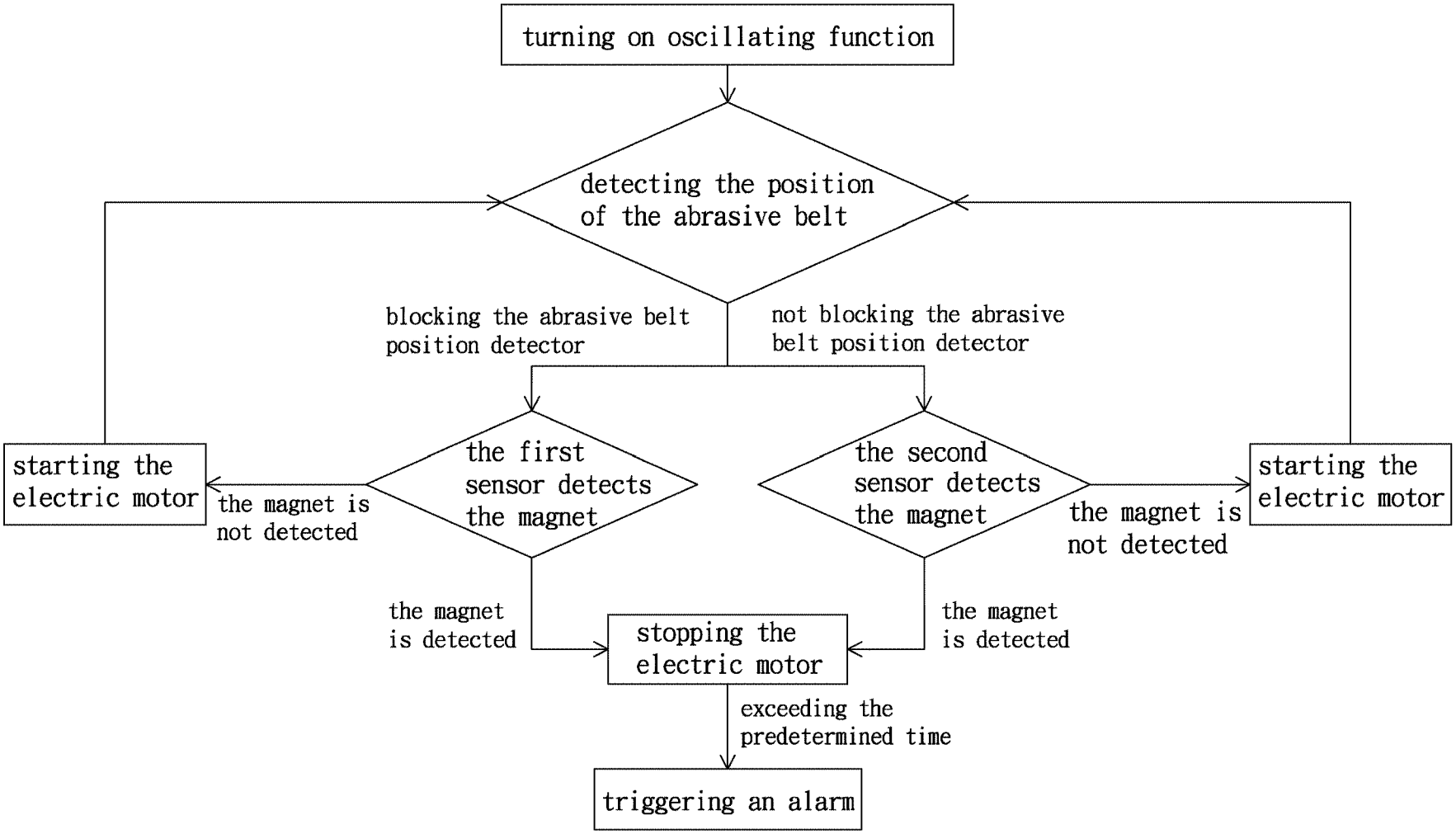
FIG. 8 is a flowchart showing the control of the electric motor of the preferred embodiment of the present invention.

Please refer to FIG. 8. When the oscillating seat 33 and the abrasive belt 336 are moved back and forth, the abrasive belt position detection module 782 will continuously detect the signal that the abrasive belt 336 is in the blocking position or not in the blocking position. When the abrasive belt 336 blocks the abrasive belt position detector 34, the magnet 422 is detected by the first oscillation angle detection module 783. If the first sensor 442 does not detect the magnet 422, the control unit 70 will control the electric motor 41 to rotate at a predetermined angle of about half a revolution to move the oscillating seat 33 and the abrasive belt 336 in the other direction. If the first sensor 442 detects the magnet 422, the control unit 70 will control the motor 41 to stop running. If the stopping time does not exceed a predetermined time, the step of detecting the position of the abrasive belt will be performed. If the stopping time exceeds the predetermined time, an alarm will be triggered. When the abrasive belt 336 doesn't block the abrasive belt position detection module 782, the magnet 422 is detected by the second oscillation angle detection module 784. If the second sensor 443 does not detect the magnet 422, the control unit 70 will control the motor 41 to rotate at a predetermined angle of about half a revolution. If the second sensor 443 detects the magnet 422, the control unit 70 will control the motor 41 to stop running. If the stopping time does not exceed a predetermined time, the step of detecting the position of the abrasive belt will be performed. If the stopping time exceeds the predetermined time, an alarm will be triggered. Thereby, the present invention can detect that the abrasive belt 336 is in the blocking position or not in in the blocking position through the abrasive belt position detection module 782, the first oscillating angle detection module 783 and the second oscillating angle detection module 784, and the electric motor 41 is controlled to drive the oscillating seat 33 and the abrasive belt 336 to move in the other direction, and the position of the abrasive belt 336 can be automatically adjusted to reciprocate left and right, so that the position of the abrasive belt 336 can be centered to avoid falling. Compared with the defect that the oscillating position of the abrasive belt is not consistent due to the difference in tension between the two sides of the conventional abrasive belt or the assembly tolerance of the belt sander, the belt sander 100 provided by the present invention has the ability to maintain the oscillating angle of the oscillating seat 33 and automatically adjust the oscillating position of the abrasive belt 336.

Besides, the user can hold the handle 63 to rotate the rotary disk 62 for moving the lifting rod 61 to drive the rotary unit 30 on the retaining bracket 21 up or down, so as to adjust the distance between the lower wheel 311 and the workbench 11 and display it on the panel 71.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A belt sander, comprising:

a base, including at least one workbench thereon;

a frame, disposed on one side of the base, the frame having a retaining bracket;

a rotary unit, including a retaining seat and a motor, the retaining seat and the motor being fixed to the retaining bracket of the frame, a lower wheel being pivotally disposed on the retaining seat, the lower wheel being connected to the motor, one end of a central axle being fixed to the retaining seat, another end of the central axle being fixed to an oscillating seat, a recess being formed on the oscillating seat, an upper wheel being pivotally connected to the oscillating seat, an abrasive belt being mounted on the upper wheel and the lower wheel;

an oscillating unit, including an electric motor, an eccentric bushing and a bearing, the electric motor being fixed to the retaining seat, the electric motor being connected to an output shaft, the output shaft having a receiving groove, the eccentric bushing being fitted on a periphery of the output shaft, the eccentric bushing and the output shaft being arranged eccentrically, the eccentric bushing having an accommodating groove corresponding to the receiving groove, a pin being inserted in the receiving groove and the accommodating groove, the bearing being fitted on the eccentric bushing and located in the recess;

an abrasive belt position detector, disposed on the retaining seat for detecting a position of the abrasive belt;

a first sensor and a second sensor, the first sensor and the second sensor being configured for confirming an oscillating angle of the oscillating seat;

a control unit, including an electric motor control module, the electric motor control module being electrically connected to the abrasive belt position detector, the first sensor and the second sensor, thereby controlling the electric motor to run or stop running;

wherein when the electric motor is running, the bearing is rotated eccentrically to drive the oscillating seat to move back and forth.

2. The belt sander as claimed in claim 1, wherein the abrasive belt position detector has a signal terminal and a reflection terminal, and a portion of the abrasive belt is between the signal terminal and the reflection terminal, thereby blocking or not blocking the abrasive belt position detector.

3. The belt sander as claimed in claim 1, wherein the eccentric bushing is located between the first sensor and the second sensor, a magnetic element is disposed on the eccentric bushing, and the first sensor and the second sensor detect a position of the magnetic element to confirm the oscillating angle of the oscillating seat.

4. The belt sander as claimed in claim 3, wherein the control unit includes an abrasive belt position detection module that is electrically connected to the abrasive belt position detector, a first oscillating angle detection module that is electrically connected to the first sensor, and a second oscillating angle detection module that is electrically connected to the second sensor; when the abrasive belt is in a blocking position and the first sensor does not detect the magnetic element, the electric motor control module controls the electric motor to run; when the abrasive belt is not in the blocking position and the second sensor does not detect the magnetic element, the electric motor control module controls the electric motor to run.

5. The belt sander as claimed in claim 4, wherein when the abrasive belt is in the blocking position and the first sensor detects the magnetic element or when the abrasive belt is not in the blocking position and the second sensor detects the magnetic element, the electric motor control module controls the electric motor to stop running.

6. The belt sander as claimed in claim 1, wherein the central axle has a retaining section, a retaining sleeve is fitted on the retaining section, the retaining sleeve is fixed to the retaining seat, a retaining rod is provided on one side of the retaining sleeve, and the retaining rod is fixed to the retaining seat.

7. The belt sander as claimed in claim 1, wherein an outer circumference of the central axle, close to the oscillating seat, has a retaining ring, and a spring is fitted on the central axle between the retaining ring and the retaining sleeve.

8. The belt sander as claimed in claim 1, further comprising a lifting adjustment unit, wherein the lifting adjustment unit includes a lifting rod, a rotary disk on one end of the lifting rod, and a handle on the rotary disk; the lifting rod has a detection section and a threaded section, a graduated sleeve is fitted on the detection section, the graduated sleeve and a detector are arranged oppositely, the detector is fixed to the frame for detecting a rotation angle of the graduated sleeve, and the threaded section is screwed to a transverse protrusion of the retaining bracket.

* * * * *